US010748372B2

(12) United States Patent
Borissov et al.

(10) Patent No.: US 10,748,372 B2
(45) Date of Patent: Aug. 18, 2020

(54) DUAL FUNCTION GAMING UNIT AND SYSTEM

(71) Applicant: Casino Technology AD, Sofia (BG)

(72) Inventors: Milo Borissov, Dubai Sports (AE); Rossi McKee, Indianapolis, IN (US)

( * ) Notice: Subject to any disclaimer, the term of this patent is extended or adjusted under 35 U.S.C. 154(b) by 53 days.

(21) Appl. No.: 15/887,868

(22) Filed: Feb. 2, 2018

(65) Prior Publication Data

US 2018/0253933 A1 Sep. 6, 2018

Related U.S. Application Data

(60) Provisional application No. 62/455,047, filed on Feb. 6, 2017.

(51) Int. Cl.
*G07F 17/32* (2006.01)

(52) U.S. Cl.
CPC ..... *G07F 17/3223* (2013.01); *G07F 17/3211* (2013.01); *G07F 17/3227* (2013.01); *G07F 17/3251* (2013.01)

(58) Field of Classification Search
None
See application file for complete search history.

(56) References Cited

U.S. PATENT DOCUMENTS

| | | | | |
|---|---|---|---|---|
| 5,332,076 | A | 7/1994 | Ziegert | |
| 8,277,319 | B2 | 10/2012 | Gong | |
| 8,956,211 | B2 | 2/2015 | Johnson | |
| 2003/0064805 | A1 * | 4/2003 | Wells | G07F 17/32 463/39 |
| 2004/0137978 | A1 | 7/2004 | Cole et al. | |
| 2007/0111787 | A1 | 5/2007 | Adams et al. | |
| 2013/0252713 | A1 | 9/2013 | Nelson et al. | |
| 2014/0121006 | A1 | 5/2014 | Johnson | |
| 2015/0154824 | A1 | 6/2015 | Johnson | |

* cited by examiner

*Primary Examiner* — James S. McClellan
*Assistant Examiner* — Peter J Iannuzzi
(74) *Attorney, Agent, or Firm* — Weide & Miller, Ltd.

(57) ABSTRACT

Embodiments of the invention comprise a gaming machine and a gaming system. The gaming machine offers one or more primary wagering games via a master gaming controller of the machine as presented by one or more primary display devices, and allows a player to access online wagering games or events via a secondary gaming unit. The secondary gaming unit may comprise a processor and a secondary display device. A player may fund wagers, including for online game play, via a player account or wallet of a payment system to which online game servers and the gaming machine communicate.

18 Claims, 3 Drawing Sheets

DUAL FUNCTION GAMING UNIT AND SYSTEM

RELATED APPLICATION DATA

This application claims priority to U.S. Provisional Patent Application Ser. No. 62/455,047, filed Feb. 6, 2017, the contents of which is incorporated in its entirety herein.

FIELD OF THE INVENTION

The present invention relates to gaming machines which are particularly adapted to presenting one or more wagering games.

BACKGROUND OF THE INVENTION

Wagering gaming is very popular. This gaming is offered in various formats. First, a player may engage in wagering gaming by playing games at a wagering gaming machine which is located at a casino. The player might also play wagering games online, e.g. by utilizing a computer or handheld communications device to access a computing network such as the Internet to communicate with a source of online games.

A new gaming machine and system is desired which offers players the ability to play casino games which are offered by a casino gaming machine and which allow the player to access and play online wagering games.

SUMMARY OF THE INVENTION

Embodiments of the invention comprise a gaming machine and a gaming system. The gaming machine offers one or more primary wagering games via a master gaming controller of the machine as presented by one or more primary display devices, and allows a player to access online wagering games or events, such as via a secondary gaming unit of the gaming machine. The secondary gaming unit may comprise a processor and a secondary display device. A player may fund wagers, including for online game play, via a player account or wallet of a payment system to which online game servers and the gaming machine communicate.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise a gaming machine and a gaming system. The gaming machine and gaming system of the invention are configured to present one or more wagering games to a player, including by allowing a player to access online games or engage in other online wagering events (sports betting, etc.).

Figure 1A:
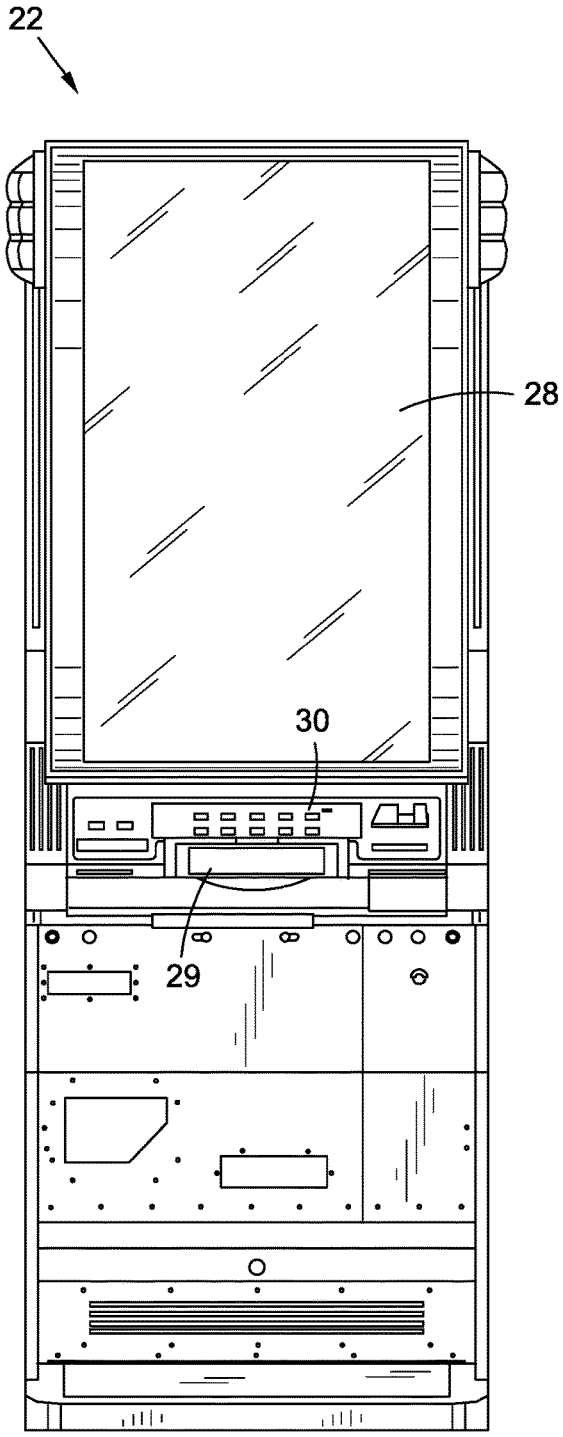
FIGS. 1A and 1B illustrate a gaming machine in accordance with one embodiment of the invention.
Figure 1B:
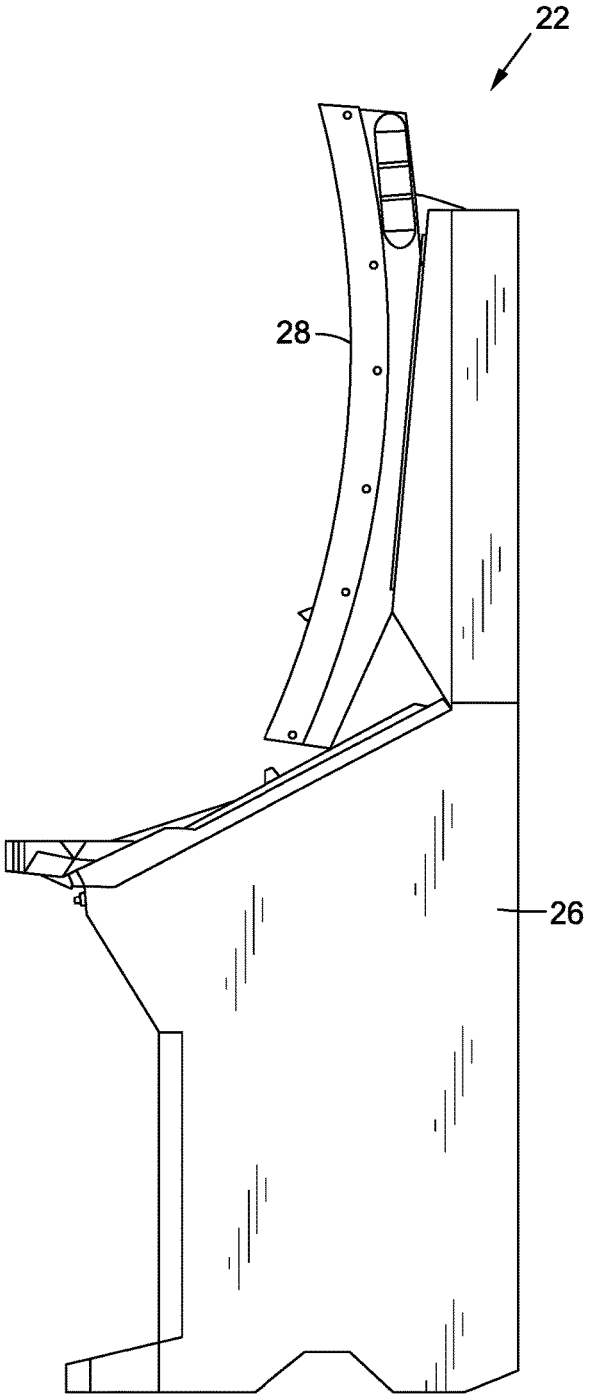

In one embodiment, the gaming machine of the invention is a dual functionality gaming unit. One embodiment of a gaming machine 22 in accordance with the invention is illustrated in FIGS. 1A and 1B.

The gaming machine 22 may be located at a casino (and as such may be referred to as a "casino gaming machine"). As described below, the gaming machine 22 may be part of a gaming system, such as a casino gaming system which links two or more of the gaming machines or one or more gaming machines with other devices, such as one or more table games, kiosks, accounting systems or servers, progressive systems or servers, player tracking systems or servers or the like. Further, as described below, the gaming machine 22 preferably links to one or more external devices such as webservers via one or more communication or computing networks, such as the Internet, whereby a player may access and play one or more online games. In one embodiment, the online games are wagering games (but they may comprise free play, play for points or games of other styles).

As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one primary display device 28 configured to display game information. The primary display 28 may comprise an electronic video display such as a cathode ray tube (CRT), high resolution flat panel liquid crystal display (LCD), projection LCD, plasma display, field emission display, digital micromirror display (DMD), digital light processing display (DLP), LCD touchscreen, a light emitting display (LED) or other suitable displays now known or later developed, in a variety of resolutions, sizes and formats (e.g. 4:3, widescreen or the like). The primary display 28 may be capable of projecting or displaying a wide variety of information, including images, symbols and other indicia or information associated with game play, game promotion or other events.

In a preferred embodiment, the gaming machine 22 includes a primary display device 28 and a secondary display device 29. In a preferred embodiment, the secondary display device 29 is also an electronic video display.

The gaming machine 22 might include one or more additional display devices. For example, the gaming machine 22 might also include a top box or other portion. Such a top box might include one or more tertiary or additional display devices. Also, the gaming machine 22 might include side displays (such as mounted to the exterior of the housing 26) and might include multiple displays of differing sizes.

While the primary display device 28 preferably comprises one or more video displays, in another embodiment, the primary display device 28 might comprise or include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate in game actions or selections, to "cash out" of the gaming machine, or to provide various other inputs.

Figure 2:
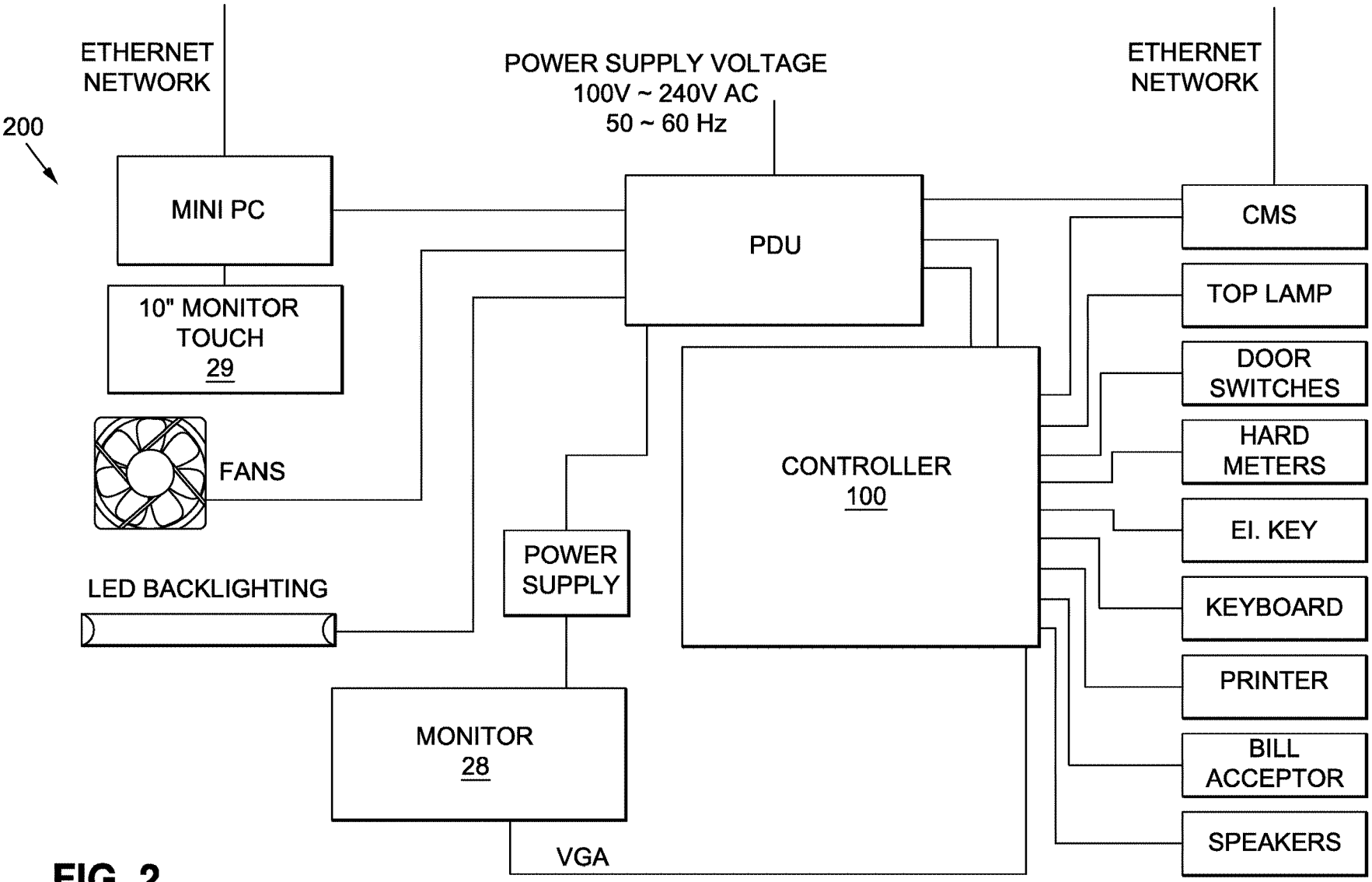
FIG. 2 is a block diagram of components of the gaming machine illustrated in FIGS. 1A and 1B.

Referring to FIG. 2, in one preferred embodiment, the gaming machine 22 includes a main or master gaming controller 100 for controlling the gaming machine, including receiving player input and sending output signals for controlling the various components or peripheral devices of the machine 22 (such as generating game information for display by the primary display 28). As illustrated, these peripherals may comprise one or more lamps, backlights, door switches, meters, keys, keyboards or keypads, buttons, printers, reading devices (such as a bill validator, ticket readers), speakers and/or other devices.

The controller 100 may be arranged to receive information regarding funds provided by a player to the gaming machine 22, receive input such as a purchase/bet signal when a purchase/bet button is depressed, and receive other inputs from a player. The controller 100 may be arranged to generate information regarding a game, such as generating game information for display by the at least one display 28, for determining winning or losing game outcomes and for displaying information regarding awards for winning game outcomes, among other things.

The controller 100 may comprise a processor which is configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 22 may also include one or more random number generators for generating random numbers (such as implemented by a random number generator software module stored in the memory and executable by the processor or controller), such as for use in selecting slot symbols, cards or other game symbols and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller 100 is configured to execute machine readable code or instructions (e.g. software) which are configured to implement one or more games. The games which the gaming machine 22 presents via the controller 100 thereof may be referred to as primary games. In this regard, the gaming machine 22 is specially configured to present games via specific software and/or hardware which causes the gaming machine to operate uniquely. For example, the controller of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine readable code may be configured in various manners, such as by having various "modules" of software which are designed to implement specific features of the game play or game presentation.

The gaming machine 22 may be configured to generate and present games in a stand-alone manner or it may be in communication with one or more external devices at one or more times. For example, the gaming machine 22 may be configured as a server based device and obtain game code or game outcome information from a remote casino game server (in which event the gaming machine controller may receive game information from the server, such as game outcome information, and use that server-generated information to present the game at the gaming machine). In this regard, it will be noted that the processor or controller of the gaming machine may comprise more than one device. For example, in a server-based environment, a controller at a server may generate game information and transmit that information to the processor or controller 100 of the gaming machine 22, where the local processor or controller at the gaming machine may then cause game information to be displayed on the primary display 28 (and/or other actions, etc., to be implemented via the peripherals, inputs to be received by the player, etc.).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, as illustrated in FIGS. 1A and 1B, the gaming machine 22 might include a coin acceptor for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. As detailed below, the mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server or payment system, as described below), a remote bank or other financial account, or an electronic device such as a player's phone, PDA or tablet.

The gaming machine 22 may also include a player tracking device, such as a card reader and associated keypad. Such player tracking devices are well known and may permit the game operator to track play of players of the gaming machine. The tracked play may be utilized to offer player bonuses or awards.

As described above, the gaming machine 22 is particularly configured to present one or more primary games. In other words, the gaming machine 22 is manufactured and designed to present certain games to the player as offered by the operator of the gaming machine (such as a casino). These games may comprise "regulated" games in the sense that they are approved by one or more regulatory or governmental agencies specifically to be implemented by the gaming machine. Most importantly, however, the gaming machine 22 offers dual or additional functionality in that it is configured to allow a player to access and play online games offered via remote or third party sources—e.g. games which the gaming machine itself is not configured or approved to present directly. In one embodiment, the gaming machine 22 of the present invention includes or comprises a secondary gaming unit 200 to implement this additional functionality.

Figure 3:
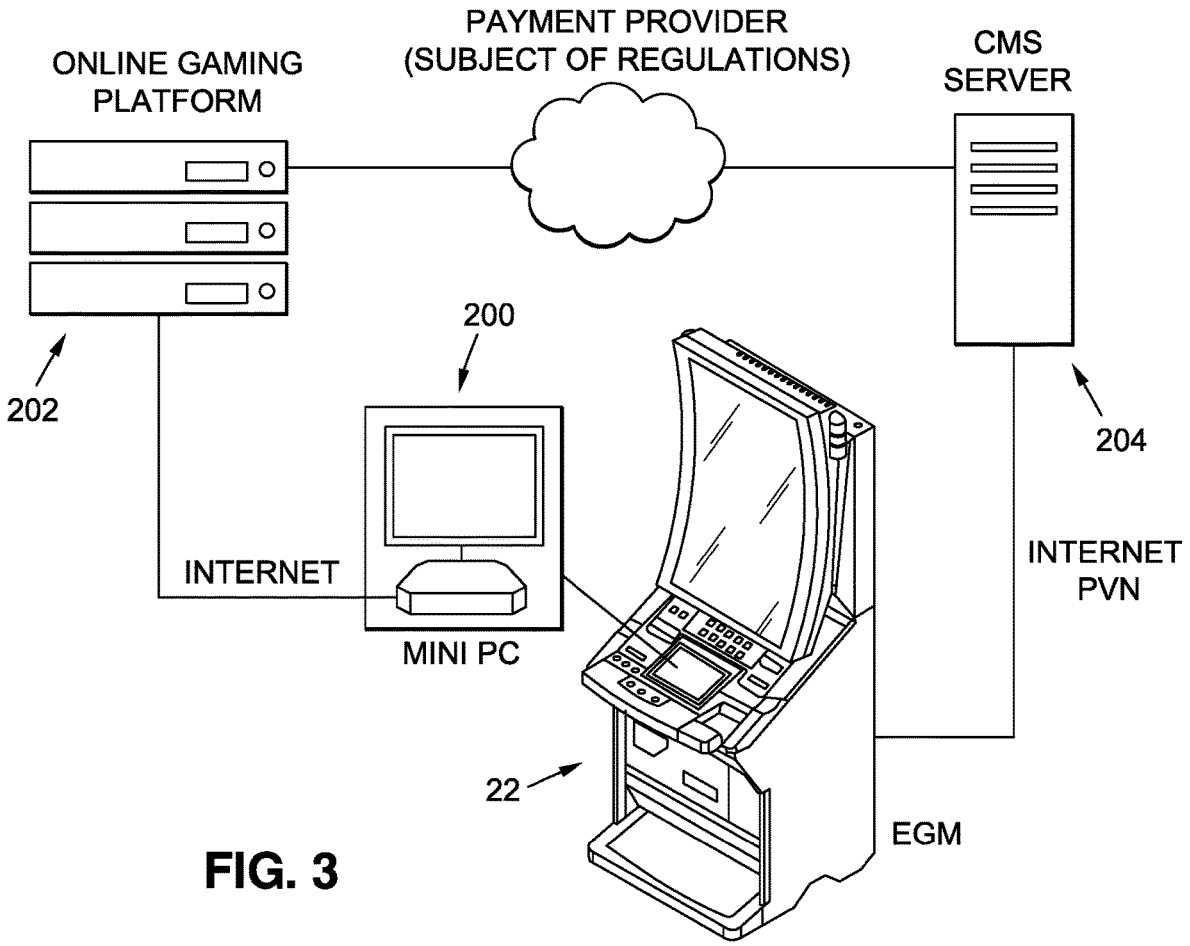
FIG. 3 illustrates one embodiment of a gaming system in accordance with the present invention.

In a preferred embodiment, the secondary gaming unit 200 comprises a secondary computing device which is associated with the gaming machine 22. As illustrated in FIG. 3, the secondary gaming unit 200 may comprise a mini computing device which is connected to or housed within the housing of the gaming machine 22.

In one embodiment, the secondary gaming unit 200 comprises at least one processor or controller which is configured to execute machine readable code or software, a memory for storing machine readable code or software, the secondary display device 29 (see FIGS. 1A and 1B as well), one or more player input devices (which may comprise, for example, a touch screen associated with the secondary display device 29 and/or other input devices), and at least one communication interface. The secondary gaming unit 200 might essentially comprise, for example, a small desktop, laptop, tablet or similar computing device which is associated with the gaming machine 22. As illustrated, the secondary gaming unit 200 is arranged so that the processor, etc., are securely located within the housing 26 of the gaming machine 22 and the secondary display device 29 faces outwardly towards the player. As illustrated, the secondary display device 29 is located at or associated with a button deck or console area of the gaming machine 22 below the primary display 28.

As illustrated in FIG. 2, the secondary gaming unit 200 may be coupled to the processor 100 of the gaming machine 22. In this manner the secondary gaming unit 200 may receive signals from or send signals to/control the peripheral devices of the gaming machine 22. In addition, the processor 100 of the gaming machine 20 may then communicate with the secondary gaming unit 200, such as to cause the secondary display device 29 to display information, to receive inputs from the player input devices of the secondary gaming unit 200 and the like.

Preferably, the secondary gaming unit 200 includes a communication interface to one or more external computing networks, and thus external computing devices. Preferably, the secondary gaming unit 200 is coupled to the Internet, such as via one or more wired or wireless communication links (which links may include one or more public and/or private networks, including LANs, WANs, etc.). The secondary gaming unit 200 may thus communicate with one or more external computing devices, such as a remote online game server 202 (see FIG. 3).

In a preferred embodiment, the secondary gaming unit 200 may include or be configured to execute a web browser (such as Internet Explorer, Chrome, Firefox or the like) which permits communications with the web servers 202, whereby web content may be displayed to the player, such as via the secondary display device 29 or the primary display device 28. In one embodiment, the secondary content comprises online or web-based games. These games may comprise a variety of online games now offered or offered in the future via various third parties. These online games may comprise wager-based games (wagering based upon monies, points, tokens or the like) or free play games or the like.

One embodiment of the invention comprises a gaming system which includes at least one gaming machine 22 and a payment or monetary management system 204 as illustrated in FIG. 3. In one embodiment, the payment or monetary management system 204 comprises a casino management system or server, such as one or more computing or server devices. The payment system 204 may track or manage monetary value accounts or values, such as monetary value which is associated with a player's casino wallet or account. As one example, a player may have a casino account having funds associated therewith.

Preferably, the player may access their casino account or wallet and access funds associated therewith for placing wagers. In one embodiment, the processor 100 of the gaming machine 22 communicates directly with the payment system 204 (see FIG. 2). In addition, one or more third party webservers 200 may communicate with the payment system 204 (see FIG. 3). In this manner, a player may utilize their player account to also use the funds therewith to fund online gaming.

As one example, upon accessing an online game site, a player may provide information regarding their player account. The third party game site operator may then contact the payment system 204 to confirm and access funds for funding the online gaming (subject to regulatory oversight, etc., as indicated).

The player might fund their player account with the casino or other payment system 204 in various manners. In one embodiment, the player might provide or transfer funds from the account, such as in currency format, electronic funds transfer from a bank or credit card account or the like. In one embodiment, the player account might comprise a wallet which includes or comprises various sources of funds (or links to those sources) such as bank accounts, credit cards or the like.

In one embodiment, a player might provide currency, a ticket or use a credit/debit card to establish a credit balance for playing games at the gaming machine 22 via the processor (e.g. primary games). The player might also access their player account to establish such a credit balance. Likewise, the player might utilize their player account to fund online gaming. The player might cash-out via moving funds to a ticket, via an attendant payout (hand pay) or by moving funds from the gaming machine 22 to the player account.

In one embodiment, it is possible for the gaming machine 22 to not even be connected to the payment system 204. In this event, a player might associate funds with the gaming machine 22 (as indicated above, such as by providing coins, currency, a credit or debit card, ticket, etc.) to establish a credit balance at the gaming machine 22. The player might use this credit balance to place primary game wagers. In this embodiment, the gaming machine 22 might also act as a kiosk or point of sale type device relative to online games. In particular, the gaming machine 22 might then serve as a device to cash in (e.g. provide funds to fund wagers) or cash out (be dispensed winnings, such as by receiving currency, a value ticket, etc.) for online game play or wagers.

Figure 4:
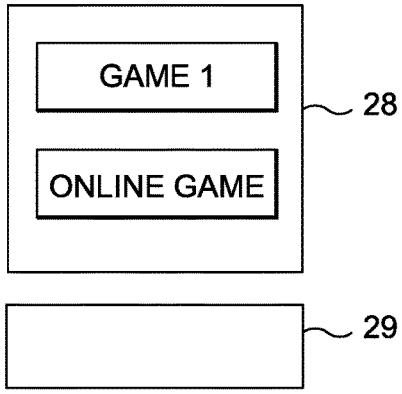
FIG. 4 illustrates one embodiment of the display of game information.
Figure 5:
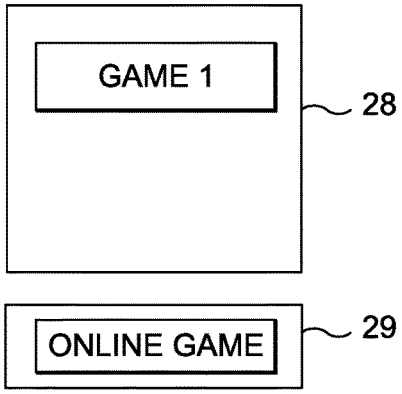
FIG. 5 illustrates another embodiment of the display of game information.

As indicated above, in one embodiment, the gaming machine 22 may be configured so that the processor 100 presents primary games via the primary display device 28 and the secondary gaming unit 200 presents online games via the secondary display device 29, such as illustrated in FIG. 5. However, in another embodiment, the operation of the gaming machine 22 is integrated: primary games and online games are presented on the primary display 28 and game operational information is displayed on the secondary display 29 (such as by displaying pay table information, help screen(s), etc.). In one embodiment, information may be displayed in on the primary display 28 in a split screen format. For example, as illustrated in FIG. 4, a top portion of the primary display 28 may display primary game information and primary games and a bottom portion of the primary display 28 might display a web browser and online games.

It will be appreciated that the games which are presented by the gaming machine 22 either directly or via the secondary gaming unit 200 may vary. For example, the gaming machine 22 may be configured to present video poker, rotating reel or video slot games, video blackjack, video roulette, baccarat or other games now known or later developed. The secondary gaming unit 200 may be configured to access and present similar games or other games. In addition, the gaming machine 22 might be configured to present or access sports betting or present skill based games or the like. For example, a player might play games of video poker as presented by the main controller 100 of the gaming machine 22, and then access an online sports betting site in order to place sports bets or play skill based games.

In one embodiment, the gaming machine 22 includes a main controller 100 for implementing or providing the primary gaming functionality and a secondary gaming unit 200 having a processor for implementing the secondary or additional wagering functionality. In another embodiment, however, the base design of the gaming machine 22 might have dual processors, one which is configured to implement the primary gaming functionality and the other of which is configured to implement the secondary gaming functionality (such as to enable online access and game play/wagering events). In yet another embodiment, the gaming machine 22 might include just one main controller which is configured to implement two distinct processes, such as to act as a primary game controller and to implement a virtual secondary gaming unit which permits online access and implements the online gaming functionality described herein.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIGS. 1A and 1B is only exemplary of one embodiment of a gaming machine. For example, it is possible to for the gaming machine to have various other configurations, including different shapes and styles and having different components than as just described.

The gaming machine 22 may, as noted above, be part of a system which includes other devices. For example, the gaming machine 22 may also communicate with one or more casino systems, such as a player tracking server or system, an accounting system or server, a ticketing system, a bonusing system, a tournament system, other gaming machines, and external devices.

In accordance with the present invention, a gaming machine is configured to present one or more primary games via a primary or master gaming controller of the gaming machine. In addition, the gaming machine includes a secondary gaming unit which allows the player to access and play online games or engage in online wagering (sports betting, etc.). In this manner, a player may play either or both of primary wagering games and online wagering games.

In addition, the gaming machine is associated with a system which facilitates payment or funding of wagers for both primary wagering games and online wagering games via a single source/mechanism.

It will be understood that the above described arrangements of devices, systems and methods are merely illustrative of applications of the principles of this invention and many other embodiments and modifications may be made without departing from the spirit and scope of the invention as defined in the claims.

What is claimed is:

1. A gaming machine comprising:

a housing;

at least one primary display device;

at least one player input device;

a primary memory device;

a master gaming controller;

machine-readable code stored in said primary memory device executable by said master gaming controller to, in response to a wager placed by a player from a player credit balance, cause said at least one primary display device to present at least one primary wagering game; and a secondary gaming unit located within the housing of the gaming machine, said secondary gaming unit comprising at least one processor, a secondary memory device, a communication interface, a secondary display device, and machine-readable code stored in said secondary memory device executable by said at least one processor to, via said communication interface, form a communication link with a remote webserver offering online wagering games, to present at least one online wagering game on the gaming machine at a same time as the at least one primary wagering game is presented.

2. The gaming machine in accordance with claim 1 wherein said at least one processor of said secondary gaming unit communicates with said master gaming controller, whereby said at least one online wagering game is presented via said at least one primary display device.

3. The gaming machine in accordance with claim 1 wherein said at least one processor of said secondary gaming unit communicates with said master gaming controller, wherein said at least one online wagering game is presented via said secondary display device.

4. The gaming machine in accordance with claim 1 wherein the secondary gaming unit is coupled to the Internet to form the communication link with the remote webserver offering online wagering games.

5. The gaming machine in accordance with claim 1 further comprising a mechanism for accepting monetary value from a player to establish a monetary value balance for placing wagers.

6. The gaming machine in accordance with claim 1 wherein the player credit balance in the gaming machine is used to fund wagers of the at least one online wagering game.

7. The gaming machine in accordance with claim 1 wherein the at least one primary wagering game is presented on a first portion of the primary display device at a same time that the at least one online wagering game is presented on a second portion of the primary display device.

8. The gaming machine in accordance with claim 1 wherein the secondary gaming unit is configured to present a web browser in addition to the at least one online game.

9. The gaming machine in accordance with claim 1 wherein the master controller is configured to be connected to a player account to fund the player credit balance.

10. The gaming machine in accordance with claim 1 wherein the master controller is configured to be connected to a player account to fund the player credit balance and to fund wagers of the at least one online wagering game.

11. A gaming machine comprising:

a housing;

at least one primary display device;

at least one player input device;

a primary memory device;

a master gaming controller;

machine-readable code stored in said primary memory device executable by said master gaming controller to, in response to a wager placed by a player from a player credit balance, cause said at least one primary display device to present at least one primary wagering game; and a secondary gaming unit located within the housing of the gaming machine, said secondary gaming unit comprising at least one processor, a secondary memory device, a communication interface, a secondary display device, and machine-readable code stored in said secondary memory device executable by said at least one processor to, via said communication interface, form a communication link with a remote webserver offering online wagering games, to present at least one online wagering game on the secondary display device.

12. The gaming machine in accordance with claim 11 wherein the secondary gaming unit is coupled to the Internet to form the communication link with the remote webserver offering online wagering games.

13. The gaming machine in accordance with claim 11 further comprising a mechanism for accepting monetary value from a player to establish a monetary value balance for placing wagers.

14. The gaming machine in accordance with claim 11 wherein the player credit balance in the gaming machine is used to fund wagers of the at least one online wagering game.

15. The gaming machine in accordance with claim 11 wherein the at least one primary wagering game is presented on a first portion of the primary display device at a same time that the at least one online wagering game is presented on the secondary display device.

16. The gaming machine in accordance with claim 11 wherein the secondary gaming unit is configured to present a web browser in addition to the at least one online game.

17. The gaming machine in accordance with claim 1 wherein the master controller is configured to be connected to a player account to fund the player credit balance.

18. The gaming machine in accordance with claim 1 wherein the master controller is configured to be connected to a player account to fund the player credit balance and to fund wagers of the at least one online wagering game.

* * * * *